United States Patent [19]

Altenweger

[11] 4,175,307

[45] Nov. 27, 1979

[54] THREAD GRIPPER

[75] Inventor: Alois Altenweger, Uster, Switzerland

[73] Assignee: Zellweger Uster AG, Uster, Switzerland

[21] Appl. No.: 887,440

[22] Filed: Mar. 16, 1978

[30] Foreign Application Priority Data

May 10, 1977 [CH] Switzerland ..... 5820/77

[51] Int. Cl.[2] ..... D03J 1/18

[52] U.S. Cl. ..... 28/211; 139/194

[58] Field of Search ..... 28/209, 210, 211; 139/194, 302, 434, 448; 289/2, 12, 13

[56] References Cited

U.S. PATENT DOCUMENTS

| | | | |
|---|---|---|---|
| 2,389,808 | 11/1945 | Moessinger | 139/194 |
| 2,602,472 | 7/1952 | Pfarrwaller | 139/194 |
| 2,786,256 | 3/1957 | Axelsson | 28/211 |
| 3,464,453 | 9/1969 | Schilde et al. | 139/194 |
| 3,974,551 | 8/1976 | Baer et al. | 28/211 |

*Primary Examiner*—Henry Jaudon

*Attorney, Agent, or Firm*—Werner W. Kleeman

[57] ABSTRACT

A thread gripper comprising at least two frictionally coacting clamping surfaces for engaging and holding threads at a textile machine, such as a warp-tying machine and the like, wherein the thread gripper performs predetermined movements. Means serve to alter the intensity of the frictional force applied by the clamping surfaces in a predetermined manner as a function of the path through which the thread gripper moves.

8 Claims, 8 Drawing Figures

THREAD GRIPPER

BACKGROUND OF THE INVENTION

The present invention relates to a new and improved construction of a thread gripper which is of the type having at least two frictionally coacting or paired clamping surfaces for engaging and holding threads at a textile machine, especially a warp-typing machine and the like.

For engaging and further transporting threads to tying machines or knotters and other preparatory machines used in the weaving industry, there are required thread grippers or clamps which engage the threads which are to be processed at a predetermined place and deliver such to a further acceptance or take-over location.

In so doing, it is to be observed that the threads which are to be clamped are positively engaged and held, however they still can be withdrawn out of the thread gripper during a transition phase while maintaining an adequate clamping action.

Thread grippers possessing a fixed clamping force cannot fulfill these requirements. It is either necessary to set the clamping force to be so strong that the thread tears when it is pulled out of the thread gripper, or else the clamping force is reduced, with the result that it is no longer adequate for the positive retention of the thread.

SUMMARY OF THE INVENTION

Hence with the foregoing in mind it is a primary object of the present invention to provide a new and improved construction of thread gripper which is not associated with the aforementioned drawbacks and limitations of the prior art proposals.

Still a further significant object of the present invention aims at the provision of a new and improved construction of thread gripper which satisfies the aforementioned requirements.

Yet a further important object of the present invention concerns a thread gripper which is relatively simple in construction and design, economical to manufacture, extremely reliable in operation, not readily subject to breakdown or malfunction, and requires a minimum of maintenance and servicing.

A further important object of the present invention concerns a new and improved construction of thread gripper or clamp which enables positively engaging and retaining threads which are to be clamped, but still permitting drawing out of the threads from the thread gripper while exerting an adequate clamping action.

Now in order to implement these and still further objects of the invention, which will become more readily apparent as the description proceeds, the thread gripper of the present invention is manifested by the features that it comprises at least two frictionally coacting paired clamping surfaces for engaging and holding threads at a textile machine, especially at a warp-tying machine and the like, wherein the thread gripper carries out predetermined movements. According to the invention, means serve to alter the intensity of the frictional force in a predetermined manner as a function of the path through which the thread gripper moves.

A variable intensity of the frictional force can be advantageously obtained if there is provided, as contemplated by the invention, an element controlled by a control cam, this element for instance acting by means of a spring upon a plunger carrying a movable clamping plate.

The path prescribed by the control cam for the element which is guided or controlled thereby can be, however, converted by means of pneumatic or hydraulic buffers into changes of the contact pressure of the clamping plate.

A further advantageous construction of the thread gripper resides in designing the aforementioned spring itself as the control cam.

BRIEF DESCRIPTION OF THE DRAWINGS

The invention will be better understood and objects other than those set forth above, will become apparent when consideration is given to the following detailed description thereof. Such description makes reference to the annexed drawings wherein each two successive Figures illustrate one respective embodiment of thread gripper or clamp shown exerting a low contact pressure and an increased contact pressure by means of its clamping surfaces, and specifically wherein.

DETAILED DESCRIPTION OF THE PREFERRED EMBODIMENTS

Figure 1:
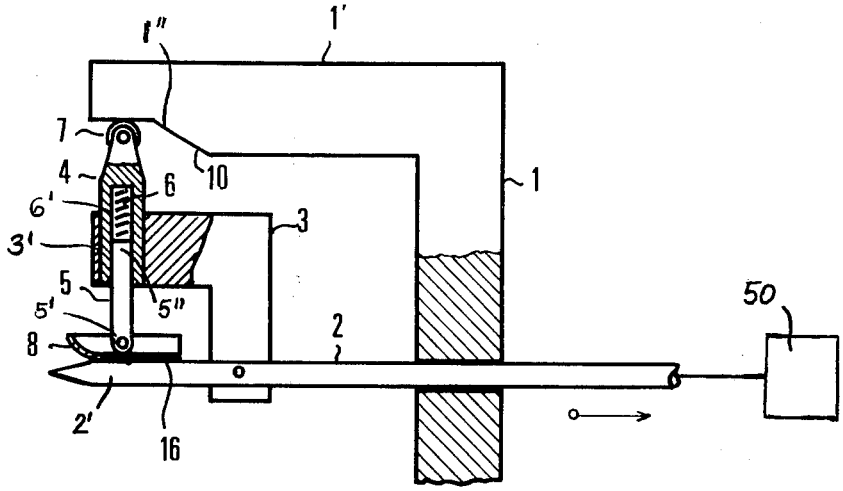
FIG. 1 is a fragmentary sectional view of a first embodiment of thread gripper having a rigid, stationary control cam and resilient pressure element, showing the parts of the thread gripper exerting a reduced contact pressure.
Figure 2:
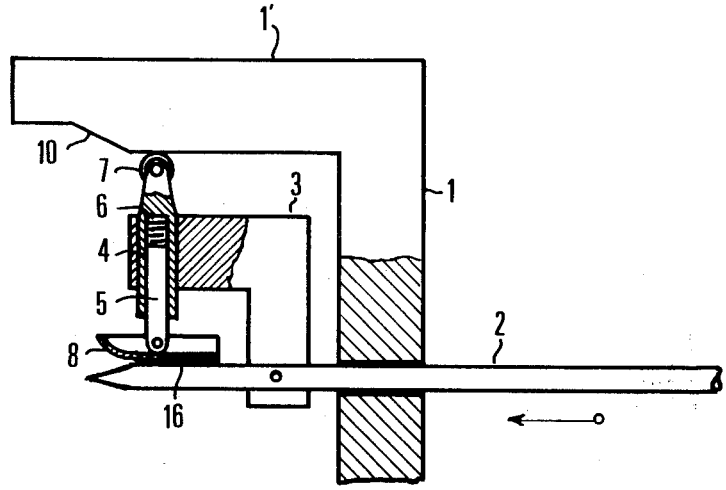
FIG. 2 illustrates the embodiment of thread gripper shown in FIG. 1 with the parts being shown exerting an increased contact pressure.

Describing now the drawings, wherein throughout the various Figures there have been used for the different illustrated embodiments generally the same reference characters to denote the same or analogous components or parts, in the exemplary embodiment of thread gripper of clamp as shown in FIGS. 1 and 2, it is to be understood that reference character 1 designates a stationary frame portion which is connected in conventional manner with or is part of a suitable textile machine, especially a warp-tying machine or knotter or the like. This frame portion or part 1 carries a flexed arm 1'. The underside 1'' of such flexed arm 1' is constructed as a control element, here shown in the form of a control cam 10.

The actual thread gripper or thread gripper device may be considered to be constituted by at least two clamping surfaces formed by the front part 2' of a support or carrier member 2 and a clamping or clamp plate 8 which bears at such support 2, for instance under the action of spring force, exerted for instance by a compression spring 6 as will be explained more fully hereinafter. The support or support member 2 is mounted to be lengthwise displaceable in relation to the stationary frame part 1 of the knotter of the like and can be moved by conventional drive mechanism, schematically indicated by reference character 50 only in FIG. 1, back and forth in the direction of the non-referenced arrows of FIGS. 1 and 2. By way of example, drive mechanism suitable for to-and-fro shifting of the support member 2 may be, for instance, constituted by a standard eccentric drive, or cam drive and coacting levers or any other suitable drive. To simplify the illustration, the drive mechanism 50 has only been shown in FIG. 1, but the same is also provided for driving the support 2 back and forth, as above-explained, for the other embodiments of thread grippers shown in FIGS. 3 to 8.

As is contemplated by the invention the intensity of the frictional force exerted by the clamping plate 8 upon the clamping surface 16 of the support member 2 depends upon the path through which the thread gripper moves, and here specifically the path through which this support member 2 moves.

To this end, the support member 2 is provided with a clamping plate guide or guide member 3 in the bore 3' of which there is displaceably mounted a spring housing 4. Into the spring housing 4 there protrudes a plunger 5 or equivalent structure which carries the clamping plate 8 at its lower plunger end 5'. The compression spring 6 or equivalent force exerting member occupies the hollow space or compartment 6' between the spring housing 4 and the upper end 5'' of the plunger 5. As such, it will be apparent that the compression spring 6 which bears at its upper end against the spring housing 4 and at its lower end against the top or upper end 5'' of the plunger 5 exerts a downwardly acting force upon the plunger 5 urging the same in the direction of the clamping surface 16. The upper closure of the spring housing 6 is formed by a roller or roll 7 which rolls upon the control cam 10.

Now in the position of the parts of the thread gripper as shown in FIG. 1, the compression spring 6 is partially relaxed, producing a smaller clamping force. Now if the support member 2 is moved towards the right, out of the position shown in FIG. 1 into the position shown in FIG. 2, then the roll 7 and thus the spring housing 4 are moved downwardly. Consequently, the plunger 5, while increasingly compressing the compression spring 6, is displaced into the spring housing 4, thereby increasing the clamping force. With the opposite movement of the support member 2 it will be apparent that the roller 7 upwardly follows the control cam 10 while relaxing the compression spring 6.

By appropriately configuring the control cam 10 it is possible to also obtain a more complicated course of the clamping forces as a function of the translatory motion of the support member 2.

Figure 3:
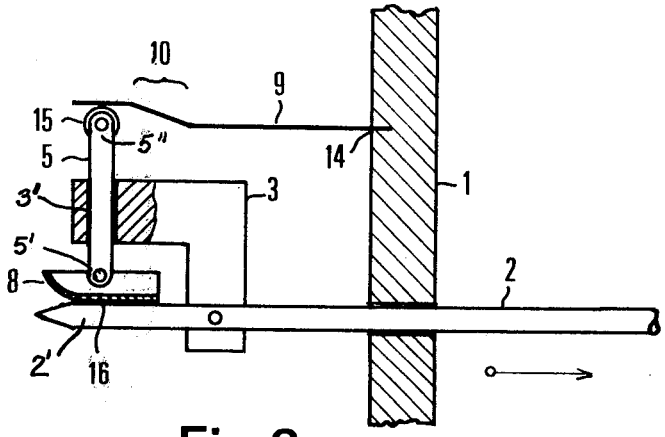
FIG. 3 is a fragmentary sectional view of a second embodiment of thread gripper with resilient, stationary control cam and rigid pressure element, the parts being shown exerting a reduced contact pressure.
Figure 4:
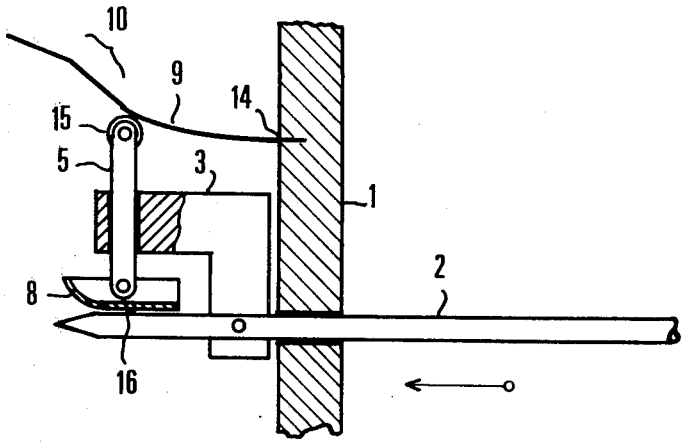
FIG. 4 illustrates the thread gripper of FIG. 3, with the parts being shown in a position exerting an increased contact pressure.

Now in FIGS. 3 and 4 there is shown a different manner of producing a variable clamping force as a function of the displacement of the support member 2. There is again employed a stationary frame part or portion 1 and a displaceable support or carrier member 2 having the clamping plate guide or guide member 3, clamping plate 8 and vertically guided plunger 5. However, in this case the plunger 5 does not move to a greater or lesser extent into a spring housing 4, as was the case for the embodiment of FIGS. 1 and 2, rather bears directly by means of the roll or roller 15, carried at its upper plunger end 5'', against the control cam 10. Here the control cam 10 is constituted by a resilient element, for instance shown as a leaf or blade spring 9 clamped in any convenient fashion at location 14 at the frame part or frame 1. Due to the displacement of the support or carrier member 2, as previously explained, and thus the plunger 5, the roller or roll 15 which terminates the plunger 5 at its upper end bends the leaf or blade spring 9 upwardly, so that such acts with an increased contact pressure by means of the plunger 5 upon the clamping plate 8, as best seen by referring to FIG. 4.

Figure 5:
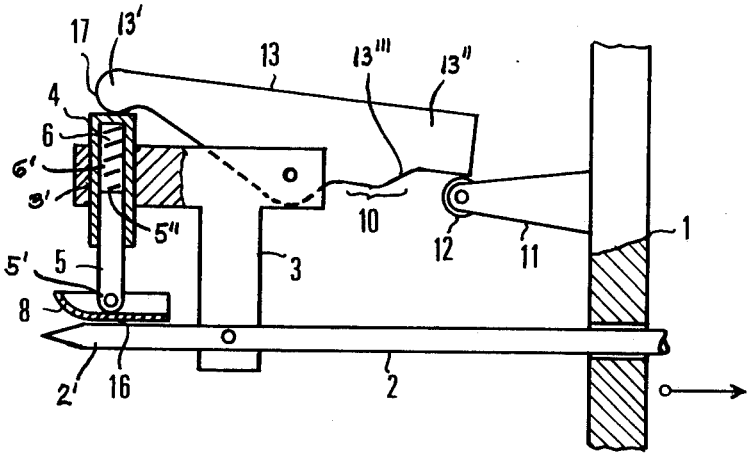
FIG. 5 is a fragmentary view, partly in section, of a third embodiment of thread gripper having rigid, displaceable control cam and resilient pressure element, the parts being shown exerting a reduced contact pressure.
Figure 6:
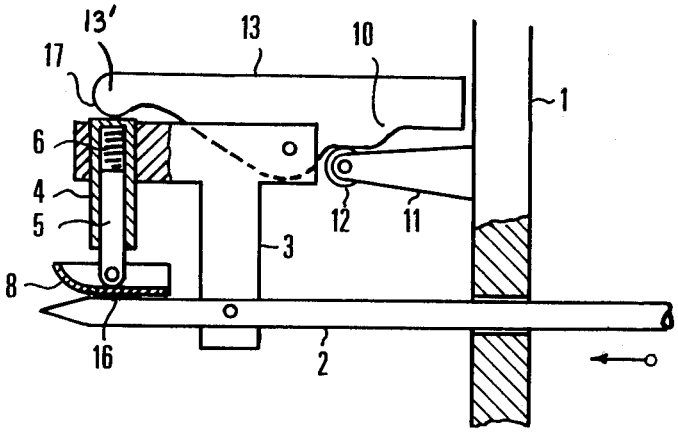
FIG. 6 illustrates the embodiment of thread gripper shown in FIG. 5, with the parts in a position exerting an increased contact pressure.

The third exemplary embodiment of thread gripper or clamp, as shown in FIGS. 5 and 6, will be seen to utilize a pivotable lever 13 mounted at the clamp plate guide 3. This pivotable lever 13 bears at one end 13' by means of a substantially spherical or bulbous portion 17 upon the spring housing 4, and its other end region 13'' has its under surface 13''' constructed as the control cam 10 which bears upon a stationary roll or roller 12 which is mounted in a roll support 11. Also in this case, during displacement of the support member 2, the control cam 10 produces via the pivotable lever 13 acting upon the spring housing 4 different penetration depths of the plunger 5 into such spring housing 4, and hence, exerts different magnitudes of clamping forces between the clamping plate 8 and the support surface 16 provided at the support member 2.

Figure 7:
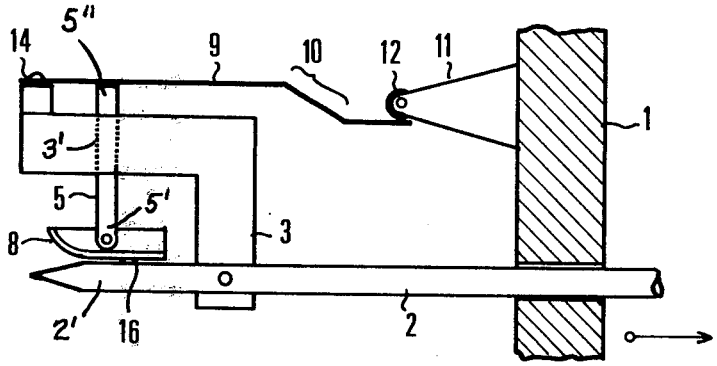
FIG. 7 illustrates a fourth embodiment of thread gripper, partially in sectional view, having resiliently displaceable control cam and rigid pressure element, the parts being shown in a position exerting reduced contact pressure.
Figure 8:
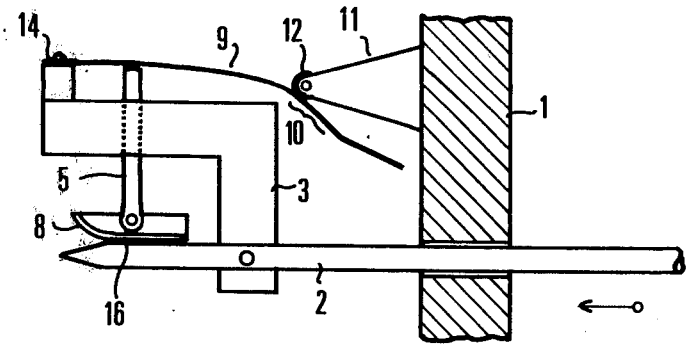
FIG. 8 illustrates the embodiment of thread gripper of FIG. 7, with the parts shown in a position exerting an increased contact pressure.

Finally, the fourth exemplary embodiment of thread gripper or clamp, as shown in FIGS. 7 and 8, constitutes an arrangement wherein the leaf or blade spring 9 is designed as the control cam and is clamped at location 14 defining clamping means at the clamp plate guide or guide member 3. The roll or roller 12 which is mounted by means of the roller support 11 at the frame part or frame 1 travels upon the blade or leaf spring 9 during shifting or displacement of the support member 2. This roll 12 thus bends the leaf spring 9 in accordance with the form imparted thereto as the control cam 10, so that there are exerted different pressure or compression forces at the upper portion or dome 5'' of the plunger 5.

In the exemplary embodiments disclosed herein there are illustrated throughout arrangements wherein there is contemplated a translatory motion of the support member 2 with the clamping elements arranged thereon. However, it is also possible, without deviating from the inventive concepts disclosed herein and further enunciated in the claims to follow, to have the motion of the support member accomplished along a circular path of travel, and thus, to control the intensity of the clamping force as a function of the angular position of the thread gripper in relation to a starting position. To this end, the control cam 10 can be either stationary—as explained with the illustrated exemplary embodiments—and a feeler roll can rotate around such control cam, or, however, there can be provided a co-rotating control cam and a fixed feeler or scanner support.

While there are shown and described present preferred embodiments of the invention, it is to be distinctly understood that the invention is not limited thereto, but may be otherwise variously embodied and practiced within the scope of the following claims.

Accordingly, what I claim is:

1. A thread gripper for engaging and holding threads at a textile machine, especially warp-tying machines and the like, comprising:

means defining at least two clamping surfaces which coact with one another in a pair for frictionally engaging and holding threads;

said means defining said at least two clamping surfaces providing a thread gripper device;

means for imparting predetermined movements to said thread gripper device;

means for varying the intensity of the frictional force acting upon the engaged threads as a function of the path of travel through which the thread gripper device moves;

said means defining said at least two clamping surfaces including a support member capable of moving relative to the textile machine and operated by said means for imparting said predetermined movements to said thread gripper device;

at least one pivotably mounted clamping plate;

means for movably mounting said clamping plate at said movable support member;

clamping plate guide member mounted on said support member and carrying said means for movably mounting said clamping plate;

said means for varying the intensity of the frictional force comprising a fixedly mounted control cam having a surface forming a transition phase; and spring means cooperating with the surface forming the transition phase of said control cam such that the clamping force changes in a predetermined manner as a function of the movement of the support member relative to the textile machine.

2. A thread gripper for engaging and holding threads at a textile machine, especially warp-tying machines and the like, comprising:

means defining at least two clamping surfaces which coact with one another in a pair for frictionally engaging and holding threads;

said means defining said at least two clamping surfaces providing a thread gripper device;

means for imparting predetermined movements to said thread gripper device;

means for varying the intensity of the frictional force acting upon the engaged threads as a function of the path of travel through which the thread gripper device moves;

said means defining said at least two clamp surfaces including a support member capable of moving relative to the textile machine and cooperating with said means for imparting said predetermined movements to said thread gripper device;

at least one pivotably mounted clamping plate;

means for movably mounting said clamping plate at said support member;

clamping plate guide member mounted on said support member and carrying said means for movably mounting said clamping plate;

said means for varying the intensity of the frictional force including a resilient control cam having a surface forming a transition phase and cooperating with said movably mounted clamping plate such that the clamping force changes in a predetermined manner as a function of the movement of the support member relative to the textile machine.

3. The thread gripper as defined in claim 2, wherein: said control cam is at least partially formed of resilient material.

4. The thread gripper as defined in claim 2, wherein: said control cam comprises a blade spring.

5. A thread gripper for engaging and holding threads at a textile machine, especially warp-tying machines and the like, comprising:

means defining at least two clamping surfaces which coact with one another in a pair for frictionally engaging and holding threads;

said means defining said at least two clamping surfaces providing a thread gripper device;

means for imparting predetermined movements to said thread gripper device;

means for varying the intensity of the frictional force acting upon the engaged threads as a function of the path of travel through which the thread gripper device moves;

said means defining said at least two clamping surfaces including a support member movable relative to the textile machine and coacting with said means for imparting said predetermined movements to the thread gripper device;

at least one movable clamping plate;

means for movably mounting said clamping plate at said support member;

said means for varying the intensity of the frictional force including a movably mounted control cam cooperating with said movable clamping plate;

an element capable of being fixedly connected with the textile machine and cooperating with said control cam;

spring means cooperating with said movable clamping plate;

said control cam, during movement of the support member, being displaced by said element relative to the support member such that said control cam changes by means of said spring means the clamping force exerted by the movable clamping plate in a predetermined manner.

6. The thread gripper as defined in claim 5, wherein: said control cam is formed at least in part of a resilient material.

7. The thread gripper as defined in claim 5, wherein: said control cam comprises a resilient member.

8. The thread gripper as defined in claim 7, wherein: said resilient member comprises spring means.

* * * * *